US007464752B2

(12) United States Patent
Dale et al.

(10) Patent No.: US 7,464,752 B2
(45) Date of Patent: Dec. 16, 2008

(54) WELLBORE APPARATUS AND METHOD FOR COMPLETION, PRODUCTION AND INJECTION

(75) Inventors: Bruce A. Dale, Sugar Land, TX (US); John W. Mohr, Surrey Hills (AU); Charles S. Yeh, Spring, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 29 days.

(21) Appl. No.: 10/549,979

(22) PCT Filed: Jan. 20, 2004

(86) PCT No.: PCT/US2004/001599

§ 371 (c)(1),
(2), (4) Date: Feb. 6, 2006

(87) PCT Pub. No.: WO2004/094784

PCT Pub. Date: Nov. 4, 2004

(65) Prior Publication Data

US 2006/0237197 A1 Oct. 26, 2006

Related U.S. Application Data

(60) Provisional application No. 60/459,151, filed on Mar. 31, 2003.

(51) Int. Cl.
*E21B 43/08* (2006.01)

(52) U.S. Cl. ..... 166/227; 166/242.3; 166/235; 166/236

(58) Field of Classification Search ..... 166/236, 166/235, 227, 230, 242.3, 278
See application file for complete search history.

(56) References Cited

U.S. PATENT DOCUMENTS 1,473,644 A 11/1923 Rodrigo (Continued)

FOREIGN PATENT DOCUMENTS

CA 2325761 5/2001

(Continued)

OTHER PUBLICATIONS

Jones, L., (1999) "Spectacular Wells Result From Alternate Path Technology", *Petroleum Engineer International*, May 1999, pp. 31-38.

(Continued)

*Primary Examiner*—Kenneth Thompson
(74) *Attorney, Agent, or Firm*—ExxonMobil Upstream Research Company Law Department

(57) ABSTRACT

A wellbore apparatus and method suitable for either wellbore completions and production. The completion and production apparatus comprises at least one primary flow joint, the primary flow joint comprising at least one three-dimensional surface defining a body capable of fluid flow with at least one permeable surface, and at least one secondary flow joint, the secondary flow joint comprising at least one three-dimensional surface defining a body capable of fluid flow with at least one permeable surface. The method comprises providing a completion and production apparatus comprising at least one primary flow joint and one secondary flow joint wherein multiple fluid flow paths can be provided. The production completion apparatus may be installed into the wellbore to provide at least two flowpaths in the wellbore during well completion, injection and production.

79 Claims, 6 Drawing Sheets

U.S. PATENT DOCUMENTS

| | | | | |
|---|---|---|---|---|
| 1,594,788 | A | 1/1925 | McLaughlin et al. | |
| 1,620,412 | A | 3/1927 | Tweeddale | |
| 2,681,111 | A | 6/1954 | Thompson | 166/235 |
| 3,556,219 | A | 1/1971 | Meldau | 166/278 |
| 4,064,938 | A | 12/1977 | Fast | 166/236 |
| 4,428,428 | A | 1/1984 | Smyrl et al. | 166/278 |
| 4,657,079 | A | 4/1987 | Nagaoka | 166/231 |
| 4,818,403 | A | 4/1989 | Nagaoka | 210/488 |
| 4,771,829 | A | 8/1990 | Jones | 166/278 |
| 4,945,991 | A | 8/1990 | Jones | 166/278 |
| 4,977,958 | A | 12/1990 | Miller | 166/205 |
| 5,004,049 | A | 4/1991 | Arterbury | 166/233 |
| 5,069,279 | A | 12/1991 | Nagaoka | 166/234 |
| 5,076,359 | A | 12/1991 | Yeh | 166/278 |
| 5,082,052 | A | 1/1992 | Jones et al. | 166/51 |
| 5,113,935 | A | 5/1992 | Jones et al. | 166/51 |
| 5,115,864 | A | 5/1992 | Gaidry et al. | 166/278 |
| 5,161,613 | A | 11/1992 | Jones | 166/242 |
| 5,161,618 | A | 11/1992 | Jones et al. | 166/308 |
| 5,165,476 | A * | 11/1992 | Jones | 166/278 |
| 5,209,296 | A | 5/1993 | Donlon | 166/276 |
| 5,222,556 | A | 6/1993 | Donlon | 166/276 |
| 5,246,158 | A | 9/1993 | Nagaoka et al. | 228/175 |
| 5,307,984 | A | 5/1994 | Nagaoka et al. | 228/189 |
| 5,311,942 | A | 5/1994 | Nagaoka | 166/232 |
| 5,318,119 | A | 6/1994 | Lowry et al. | 166/228 |
| 5,332,045 | A | 7/1994 | Ross et al. | 166/387 |
| 5,333,688 | A | 8/1994 | Jones et al. | 166/278 |
| 5,333,689 | A | 8/1994 | Jones et al. | 166/278 |
| 5,341,880 | A | 8/1994 | Thorstensen et al. | 166/278 |
| 5,355,949 | A | 10/1994 | Sparlin et al. | 166/236 |
| 5,390,966 | A | 2/1995 | Cox et al. | 285/137.1 |
| 5,392,850 | A | 2/1995 | Cornette et al. | 166/51 |
| 5,396,954 | A | 3/1995 | Brooks | 166/187 |
| 5,417,284 | A | 5/1995 | Jones | 166/280 |
| 5,419,394 | A | 5/1995 | Jones | 166/51 |
| 5,435,391 | A | 7/1995 | Jones | 166/308 |
| 5,450,898 | A * | 9/1995 | Sparlin et al. | 166/227 |
| 5,476,143 | A | 12/1995 | Sparlin et al. | 166/233 |
| 5,505,260 | A | 4/1996 | Anderson et al. | 166/278 |
| 5,515,915 | A | 5/1996 | Jones et al. | 166/51 |
| 5,560,427 | A | 10/1996 | Jones | 166/280 |
| 5,588,487 | A | 12/1996 | Bryant | 166/51 |
| 5,642,781 | A | 7/1997 | Richard | 166/231 |
| 5,690,175 | A | 11/1997 | Jones | 166/278 |
| 5,787,980 | A | 8/1998 | Sparlin et al. | 166/231 |
| 5,803,179 | A * | 9/1998 | Echols et al. | 166/370 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,881,809 | A | 3/1999 | Gillespie et al. | |
| 5,890,533 | A | 4/1999 | Jones | 166/51 |
| 5,896,928 | A | 4/1999 | Coon | 166/373 |
| 5,934,376 | A | 8/1999 | Nguyen et al. | 166/278 |
| 6,003,600 | A | 12/1999 | Nguyen et al. | 166/281 |
| 6,112,817 | A | 9/2000 | Voll et al. | 166/370 |
| 6,125,932 | A | 10/2000 | Hamid et al. | 166/233 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,298,916 | B1 | 10/2001 | Tibbles et al. | 166/278 |
| 6,302,207 | B1 | 10/2001 | Nguyen et al. | 166/276 |
| 6,409,219 | B1 | 6/2002 | Broome | 285/3 |
| 6,516,881 | B2 | 2/2003 | Haley, Jr. | 166/278 |
| 6,540,022 | B2 | 4/2003 | Dusterhoff et al. | 166/278 |
| 6,575,245 | B2 | 6/2003 | Hurst et al. | 166/278 |
| 6,575,251 | B2 | 6/2003 | Watson et al. | 166/387 |
| 6,581,689 | B2 | 6/2003 | Haley, Jr. | 166/278 |
| 6,588,506 | B2 | 7/2003 | Jones | 166/278 |
| 6,644,406 | B1 | 11/2003 | Jones | 166/308 |
| 6,695,067 | B2 | 2/2004 | Johnson et al. | 166/387 |
| 6,698,518 | B2 | 3/2004 | Royer et al. | 166/278 |
| 6,715,544 | B2 * | 4/2004 | Gillespie et al. | 166/230 |
| 6,749,023 | B2 | 6/2004 | Nguyen et al. | 166/278 |
| 6,752,207 | B2 | 6/2004 | Donos | 166/278 |
| 6,817,410 | B2 | 11/2004 | Wetzel et al. | 166/233 |
| 6,848,510 | B2 | 2/2005 | Bixenman et al. | 166/278 |
| 6,857,475 | B2 * | 2/2005 | Johnson | 166/278 |
| 6,986,390 | B2 | 1/2006 | Doane et al. | 166/285 |
| 2003/0159825 | A1 | 8/2003 | Hurst et al. | 166/278 |
| 2005/0039917 | A1 | 2/2005 | Travis | 166/287 |
| 2005/0045329 | A1 | 3/2005 | Wetzel et al. | 166/278 |
| 2005/0067170 | A1 | 3/2005 | Richard | 166/387 |
| 2005/0082060 | A1 | 4/2005 | Ward et al. | 166/278 |
| 2005/0178562 | A1 | 8/2005 | Livingstone | 166/386 |

FOREIGN PATENT DOCUMENTS

| | | |
|---|---|---|
| EP | 0 622 523 A2 | 11/1994 |
| EP | 1087099 | 3/2001 |
| EP | 1132571 | 9/2001 |
| WO | WO 00/61913 | 10/2000 |
| WO | WO 01/14691 | 3/2001 |

OTHER PUBLICATIONS

Penberthy, W. L. et al. (1992) *Sand Control*, ISBN 1-55563-041-3.

Supplemental EP Search Report 04 70 3682, dated Apr. 7, 2006 (1 page).

Penberthy, W. L. et al. (1992) Sand Control ; Gravel Pack Screens (a) Baker Sand Control; (b) Howard Smith Screen Co. (c) UOP, Inc. Johnson Div.

"Alternate Path Gravel Packing"; L.G. Jones et al.. δSPE22796, presented 66th Annual SPE Conference in Dalls, TX on Oct. 6-9, 1991.

* cited by examiner

WELLBORE APPARATUS AND METHOD FOR COMPLETION, PRODUCTION AND INJECTION

CROSS REFERENCE TO RELATED APPLICATIONS

This application is the National Stage of International Application No. PCT/US04/01599, filed 20 Jan. 2004, which claims the benefit of U.S. Provisional Application No. 60/459,151 filed Mar. 31, 2003.

FIELD OF THE INVENTION

This invention relates generally to an apparatus and method for use in wellbores. More particularly, this invention relates to a wellbore production completion maze apparatus and method suitable for fluid production and gravel packing.

BACKGROUND

Hydrocarbon production from subterranean formations commonly includes a wellbore completed in either cased hole or open hole condition. In cased-hole applications, a wellbore casing is placed in the wellbore and the annulus between the casing and the wellbore is filled with cement. Perforations are made through the casing and the cement into the production zones to allow formation fluids (such as, hydrocarbons) to flow from the production zones into the casing. A production string is then placed inside the casing, creating an annulus between the casing and the production string. Formation fluids flow into the annulus and then into the production string to the surface through tubing associated with the production string. In open-hole applications, the production string is directly placed inside the wellbore without casing or cement. Formation fluids flow into the annulus between the formation and the production string and then into production string to surface.

When producing fluids from subterranean formations, especially poorly consolidated formations or formations weakened by increasing downhole stress due to wellbore excavation and fluids withdrawal, it is possible to produce solid material (for example, sand) along with the formation fluids. This solids production may reduce well productivity, damage subsurface equipment, and add handling cost on the surface. Several downhole solid, particularly sand, control methods being practiced in industry are shown in FIGS. 1(*a*), 1(*b*), 1(*c*) and 1(*d*). In FIG. 1(*a*), the production string or pipe (not shown) typically includes a sand screen or sand control device 1 around its outer periphery, which is placed adjacent to each production zone. The sand screen prevents the flow of sand from the production zone 2 into the production string (not shown) inside the sand screen 1. Slotted or perforated liners can also be utilized as sand screens or sand control devices. FIG. 1(*a*) is an example of a screen-only completion with no gravel pack present.

One of the most commonly used techniques for controlling sand production is gravel packing in which sand or other particulate matter is deposited around the production string or well screen to create a downhole filter. FIGS. 1(*b*) and 1(*c*) are examples of cased-hole and open-hole gravel packs, respectively. FIG. 1(*b*) illustrates the gravel pack 3 outside the screen 1, the wellbore casing 5 surrounding the gravel pack 3, and cement 8 around the wellbore casing 5. Typically, perforations 7 are shot through the wellbore casing 5 and cement 8 into the production zone 2 of the subterranean formations around the wellbore. FIG. 1(*c*) illustrates an open-hole gravel pack wherein the wellbore has no casing and the gravel pack material 3 is deposited around the wellbore sand screen 1.

A variation of a gravel pack involves pumping the gravel slurry at pressures high enough so as to exceed the formation fracture pressure (frac pack). FIG. 1(*d*) is an example of a Frac-Pack. The well screen 1 is surrounded by a gravel pack 3, which is contained by a wellbore casing 5 and cement 8. Perforations 6 in the wellbore casing allow gravel to be distributed outside the wellbore to the desired interval. The number and placement of perforations are chosen to facilitate effective distribution of the gravel packing outside the wellbore casing to the interval that is being treated with the gravel-slurry.

Flow impairment during production from subterranean formations can result in a reduction in well productivity or complete cessation of well production. This loss of functionality may occur for a number of reasons, including but not limited to, migration of fines, shales, or formation sands, inflow or coning of unwanted fluids (such as, water or gas, formation of inorganic or organic scales, creation of emulsions or sludges), accumulation of drilling debris (such as, mud additives and filter cake), mechanical damage in sand control screen, incomplete gravel pack, and mechanical failure due to borehole collapse, reservoir compaction/subsidence, or other geomechanical movements.

U.S. Pat. No. 6,622,794 discloses a screen equipped with flow control device comprising helical channels. The fluid flow through screen could be reduced via helical paths, fully opened, or completely closed by controlling downhole apertures from the surface. U.S. Pat. No. 6,619,397 discloses a tool for zone isolation and flow control in horizontal wells. The tool is composed of blank base pipes, screens with closeable ports on the base pipe, and conventional screens positioned in an alternating manner. The closeable ports allow complete gravel pack over the blank base pipe section, flow shutoff for zone isolation, and selective flow control. U.S. Pat. No. 5,896,928 discloses a flow control device placed downhole with or without a screen. The device has a labyrinth which provides a tortuous flow path or helical restriction. The level of restriction in each labyrinth is controlled by a sliding sleeve so that flow from each perforated zone (for example, water zone, oil zone) can be adjusted. U.S. Pat. No. 5,642,781 discloses a wellbore screen jacket composed of overlapped helical-shaped members wherein the openings allow fluid flow through alternate contraction, expansion and provide fluid flow direction change in the wellbore (or multi-passage). Such design may mitigate solids plugging of screen jacket openings by establishing both filtering and fluid flow momentum advantages.

Current industry well designs include little, if any, redundancy in the event of problems or failures resulting in flow impairment. In many instances, the ability of a well to produce at or near its design capacity is sustained by only a "single" barrier to the impairment mechanism (for example, screen for ensuring sand control in unconsolidated formations). In many instances the utility of the well may be compromised by impairment occurring in a single barrier. Therefore, overall system reliability is very low. Flow impairment in wells frequently leads to expensive replacement drilling or workover operations.

The current industry standard practice utilizes some type of sand screen either alone or in conjunction with artificially placed gravel packs (sand or proppant) to retain formation sand. All of the prior art completion types are "single barrier" completions, with the sand screen being the last "line of defense" in preventing sand from migrating from the wellbore into the production tubing. Any damage to the installed gravel pack or screen will result in failure of the sand control completion and subsequent production of formation sand. Likewise, plugging of any portion of the sand control completion (caused by fines migration, scale formation, etc.) will result in partial or complete loss of well productivity.

Lack of any redundancy in the event of mechanical damage or production impairment results in the loss of well productivity from single barrier completion designs. Accordingly, there is a need for a well completion apparatus and method to provide multiple flow pathways inside the wellbore that provides redundant flow pathways in the event of mechanical damage or production impairment.

SUMMARY

A wellbore apparatus is disclosed. The apparatus comprises a first flow joint in a wellbore, the first flow joint comprising at least one three-dimensional surface defining a first fluid flow path through the wellbore with at least one section of the first flow joint surface being permeable and at least one section of the first flow joint surface being impermeable. A second flow joint in a wellbore, the second flow joint comprising at least one three-dimensional surface defining a second fluid flow path through the wellbore with at least one section of the second flow joint surface being permeable and at least one section of the second flow joint surface being impermeable. At least one permeable section of the first flow joint is connected to at least one permeable section of the second flow joint thereby providing at least one fluid flow path between the first flow joint and the second flow joint. In one embodiment, at least one flow joint comprises a shunt tube to provide a flow path to the annulus for gravel packing.

A method of well completion, production and injection is also disclosed. The method comprises providing a wellbore completion apparatus for gravel packing and for producing hydrocarbons in a wellbore. The wellbore completion apparatus comprising a first and second flow joint in a wellbore. The first flow joint comprising at least one three-dimensional surface defining a first fluid flow path through the wellbore with at least one section of the first flow joint surface being permeable and at least one section of the first flow joint surface being impermeable. The second flow joint comprising at least one three-dimensional surface defining a second fluid flow path through the wellbore with at least one section of the second flow joint surface being permeable and at least one section of the second flow joint surface being impermeable. At least one permeable section of the first flow joint is connected to at least one permeable section of the second flow joint thereby providing at least one fluid flow path between the first flow joint and the second flow joint. The production apparatus is installed into the wellbore to thereby providing multiple flowpaths in the wellbore. Hydrocarbons can then be produced from the well using the installed production apparatus.

BRIEF DESCRIPTION OF THE DRAWINGS

FIG. 1(*b*) is an illustration of a cased-hole gravel pack sand control completion;

FIG. 1(*c*) is an illustration of an open-hole gravel pack sand control completion;

FIG. 1(*d*) is an illustration of a frac-pack sand control completion;

FIG. 2(*b*) is a cross-section illustration of fluid production from a subterranean formation using the Mazeflo completion system of FIG. 2(*a*);

FIG. 3(*b*) is a cross-section illustration of a flow joint configuration using permeable or partially permeable surfaces attached to a concentric tube inside a wellbore;

FIG. 3(*c*) is a cross-section illustration of a flow joint configuration using a permeable or partially permeable surface with multiple eccentric tubes inside the wellbore;

FIG. 3(*d*) is a side-view illustration of the flow joint configuration of FIG. 3(*a*) using a permeable or partially permeable surfaces;

FIGS. 4(*b*), 4(*c*) and 4(*d*) are cross-sectional views of FIG. 4(*a*) at designated locations of the wellbore;

FIGS. 5(*b*), 5(*c*) and 5(*d*) with are cross-sectional views of FIG. 5(*a*) at designated locations of the wellbore;

FIG. 6(*b*) is a end view of a wellbore using an embodiment of the Mazeflo completion system illustrating a possible fluid flowpath during sand infiltration into the wellbore.

DETAILED DESCRIPTION

Figure 1A:
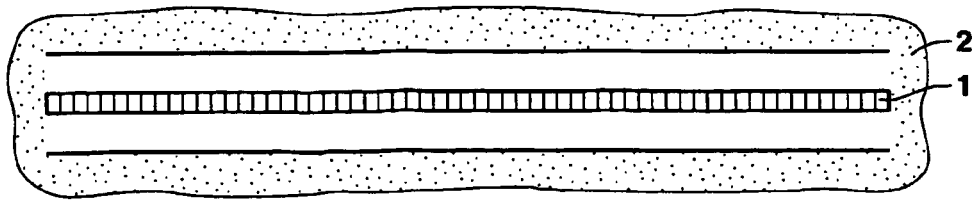
FIG. 1(*a*) is an illustration of a bare screen sand control completion.
Figure 1B:
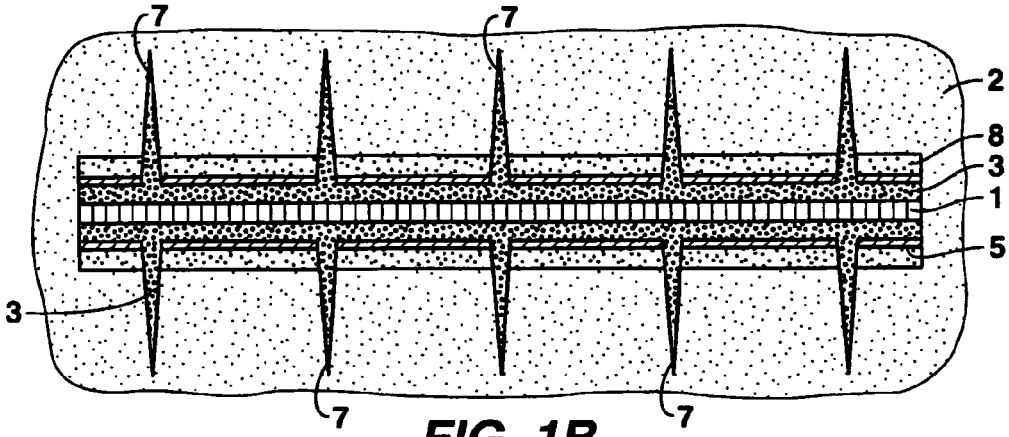
Figure 1C:
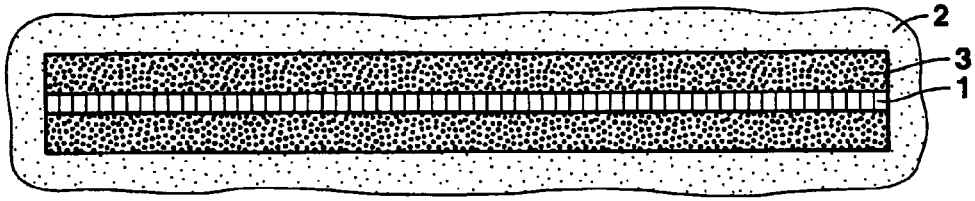
Figure 1D:
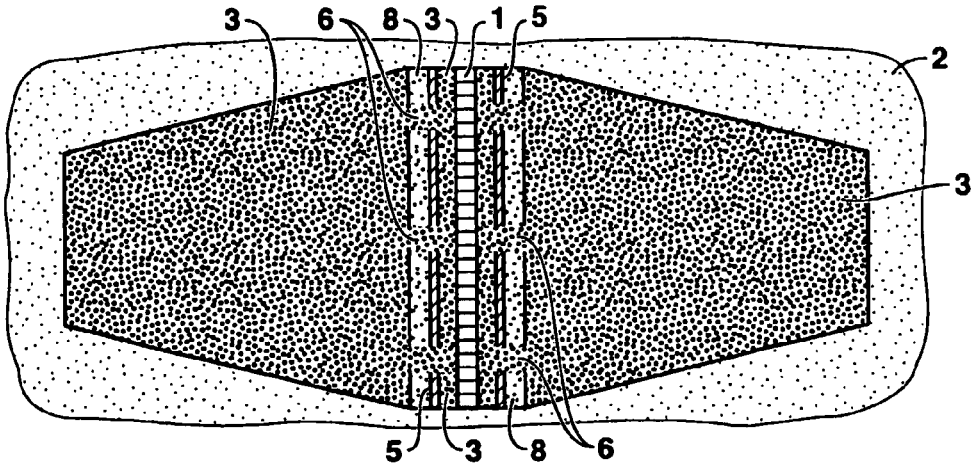
FIG. 1D (PRIOR ART)

In the following detailed description, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

This invention describes an apparatus that embodies a well completion design providing significant flowpath redundancies to address wellbore mechanical damage and flow impairment problems in wells. The invention is referred to as a "Mazeflo completion" system or the wellbore completion apparatus or system since it utilizes the concept of a maze in the design of a completion. The maze design permits greater flexibility, selectivity, and self-adjusting control in the event of mechanical damage or production flow impairment problems in wells.

This invention is referred to as a Mazeflo completion system or apparatus because the apparatus involves installation (completion) in a wellbore. The claimed apparatus may be used for completing, gravel packing, flow control, providing hydrocarbon and fluid injecting. Persons skilled in the art with the benefit of the disclosure herein will recognize multiple applications for the apparatus. All such applications and methods for using the apparatus are intended to be within the scope of the claims.

The Mazeflo completion system in the wellbore allows the isolation of flow impairing materials while still permitting the movement of fluids through other available pathways in the well. The Mazeflo completion system comprises flow joints or three-dimensional surface (such as, a cylindrical surface) defining a fluid flow path or hollow body capable of transporting fluids such as, tubular or channel-section piping with various permeable and impermeable surfaces. The use of various combinations of permeable and impermeable surfaces, walls and baffles or flow diverters permits the construction of multiple compartmentalized fluid flow paths. The compartmentalized fluid flow paths ensure the continuous production of fluids from within and around the well.

The use of baffles may include walls to completely or partially divide the compartments to redirect the fluid flow paths or change the fluid flow velocity. Baffles can be used as the permeable or impermeable surfaces of the flow joints. Permeable surfaces may be constructed from a variety of materials and devices. Permeable surface devices include but are not limited to: wire-wrapped screens, membrane screens, expandable screens, sintered metal screens, wire-mesh screens, slotted liners, perforated liners, or pre-packed solid particle beds.

A Mazeflo completion system can be constructed using numerous combinations of flow joints creating distinct flow path including sections of both separate and commingled fluid flow pathways. Examples of creating flow joints include placing or attaching permeable or impermeable materials juxtapositionally, either concentrically or adjacent to each other. The compartments may be positioned longitudinally or transverse to one another, or possibly bundled and manifolded at some locations. The Mazeflo completion system may also be accommodated by or protected by an outer shroud. Depending upon the amount of flow impairment and the specific design, the compartments can serve as redundant fluid flow paths (such as, primary, secondary, tertiary, etc. flow paths).

Figure 2A:
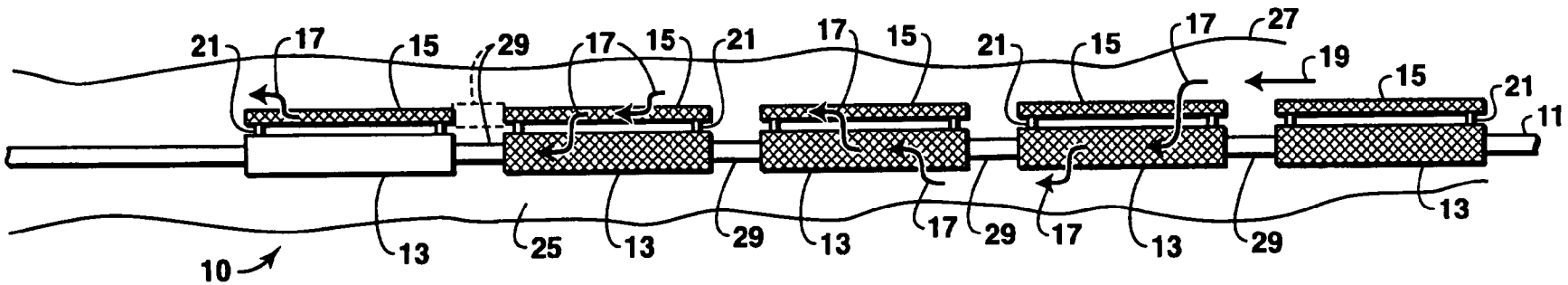
FIG. 2(*a*) is an illustration of fluid production from a subterranean formation using an embodiment of the Mazeflo completion system.
Figure 2B:
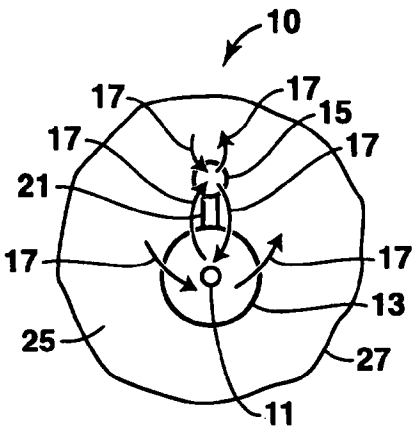
Figure 3D:
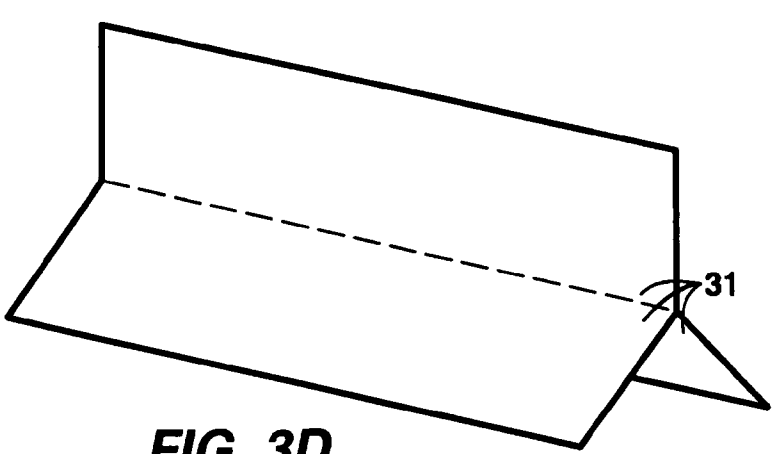
FIG. 3(*a*) is a cross-section illustration of a possible flow joint configuration using permeable or partially permeable surfaces.
Figure 3C:
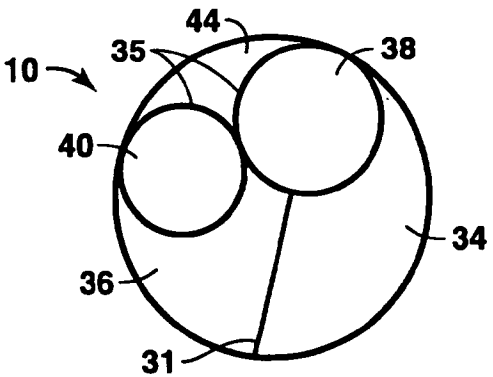
Figure 3A:
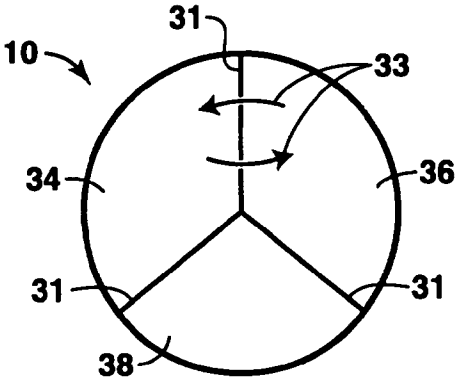
Figure 3B:
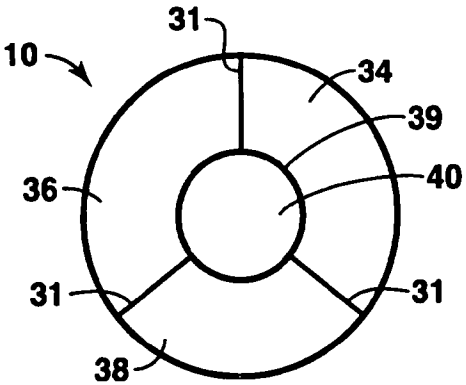
Figure 4D:
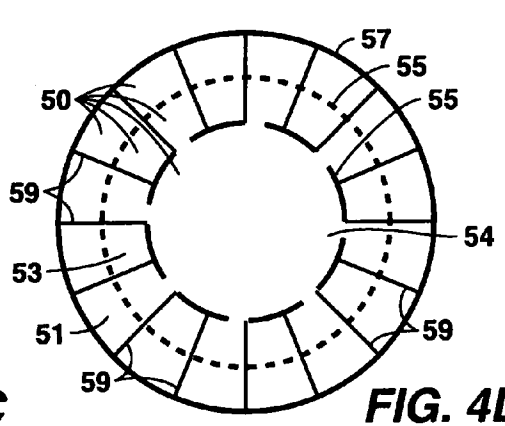
FIG. 4(*a*) is a longitudinal view of concentric multiple flow joints in a wellbore.
Figure 4C:
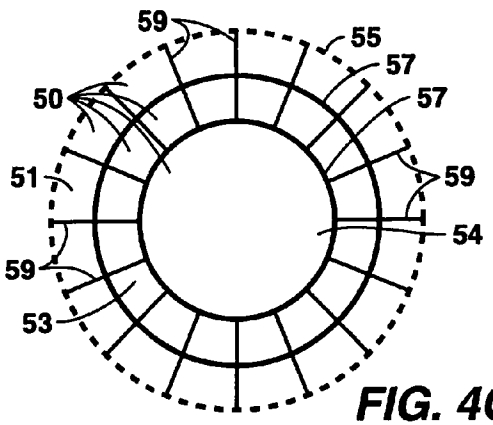
Figure 4B:
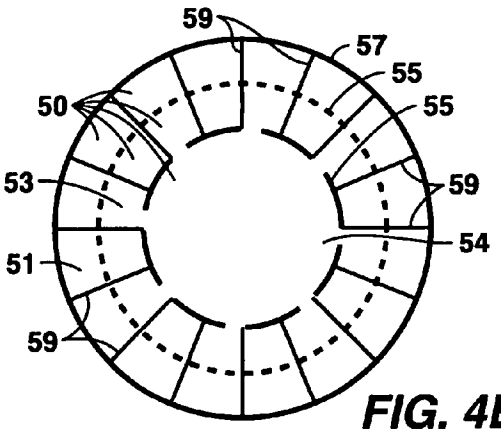
Figure 4A:
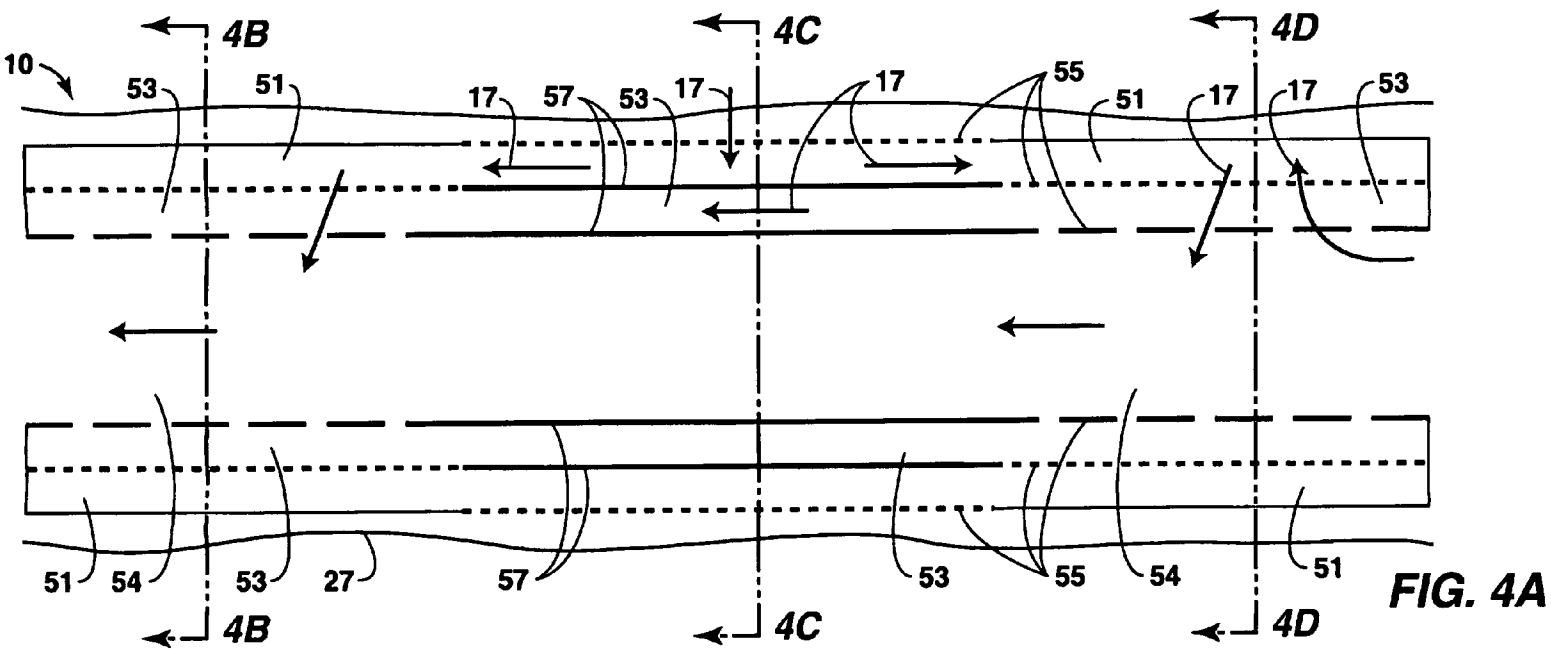
Figure 5D:
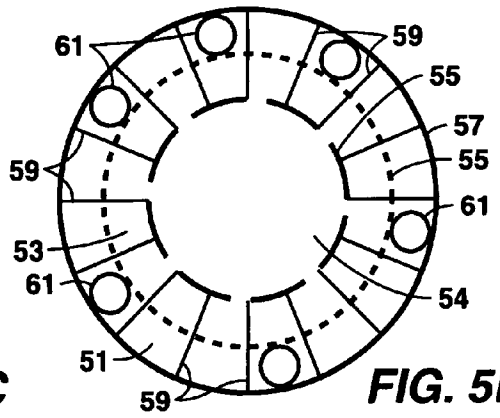
FIG. 5(*a*) is the longitudinal view of concentric multiple flow joints further illustrating possible placements for shunt tubes and nozzle ports.
Figure 5C:
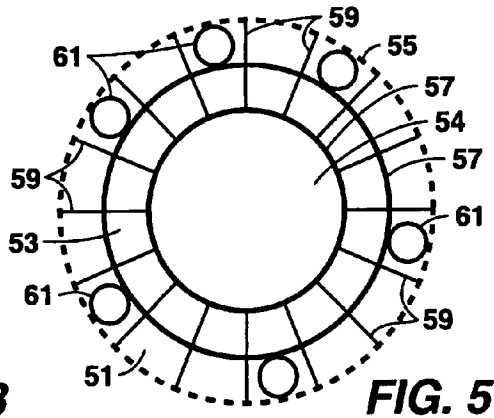
Figure 5B:
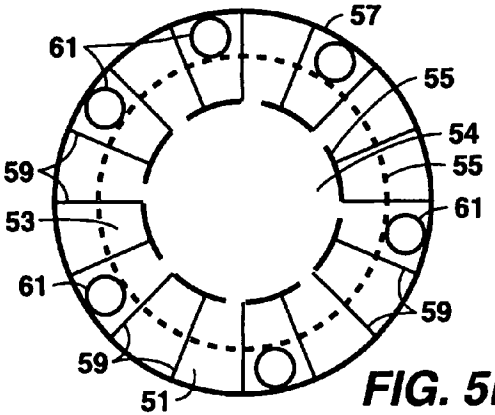
Figure 5A:
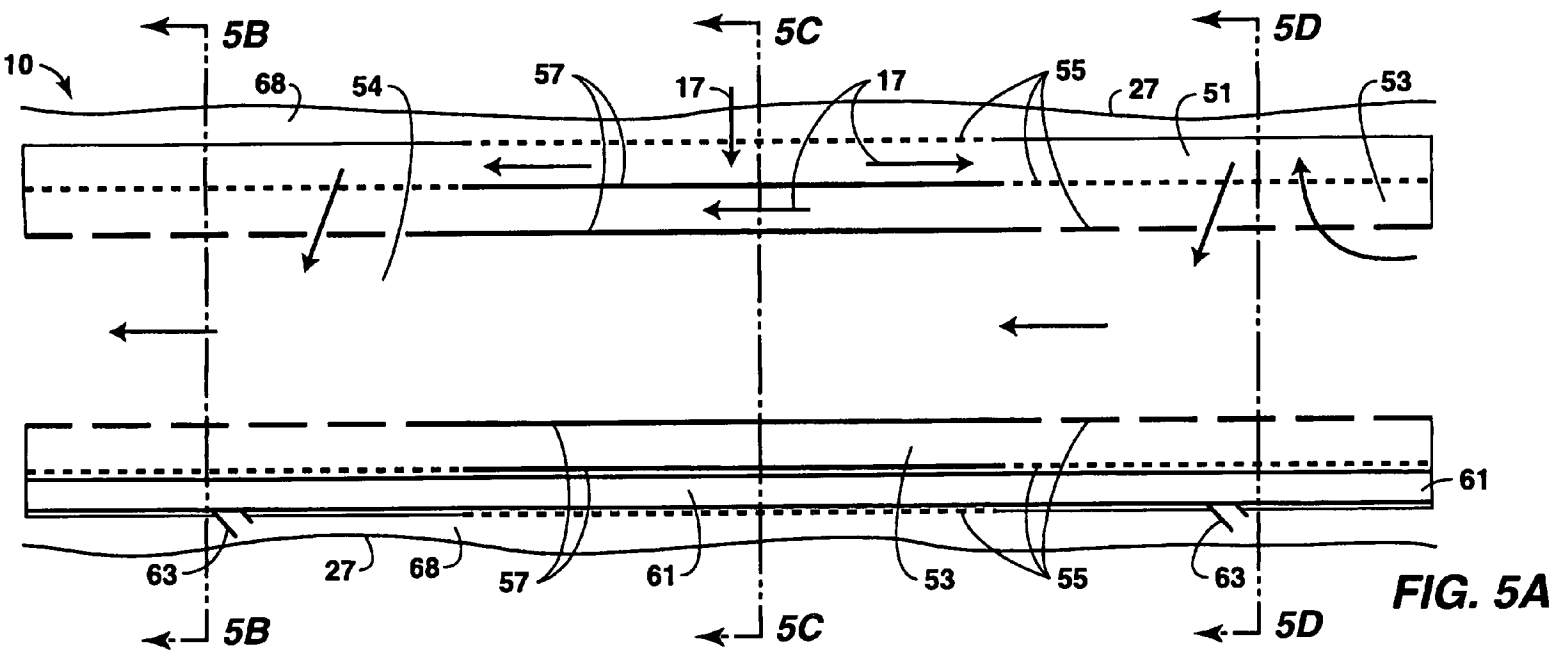

FIG. 2(*a*) illustrates fluid production from a wellbore 10 in a subterranean formation using an embodiment of the Mazeflo completion system. In this embodiment of the Mazeflo completion system, a number of first or primary 13 and second or secondary 15 longitudinal cylindrical permeable joints of pipe are used. Impermeable joints 29 or flexible joints may be used to connect the joints of pipe.

The term primary is used to designate the joints through which the operator believes the largest amount of fluid flow will initially occur. Secondary flow joints and tertiary or second and third or higher flow joints respectively are alternate fluid flow paths that are typically (but not always) smaller in size. In fact, the majority of flow may occur in the second or if available third or higher numbered flow joints. Thus, the determination of primary and secondary flow joints is purely illustrative. Labeling of flow joints as primary, secondary, and tertiary flow joints can facilitate understanding the invention as there will most likely be a preferred first flow path (or primary flow joint), a second flow path (or secondary flow joint) and possibly a third flow path (tertiary flow joint). Therefore, the designation of primary, secondary, and tertiary flow joints is arbitrary and is not meant to limit the scope of the invention. Alternatively, as discussed above, the flow joints may be labeled, first, second, third and higher, if necessary, rather than primary, secondary and tertiary flow joints and vice versa. The fluid flow may be production fluids (fluids removal out of the well or injection fluids (fluids that are injected into the well).

In the embodiment illustrated in FIG. 2(*a*), a production string 11 is placed inside a wellbore 10. Outside of the production string are at least two flow joints or three-dimensional cylindrical surfaces defining a hollow body capable of fluid flow. In FIG. 2(*a*), at least one set of joints is a first (or primary) flow joint 13. The first flow joint 13 comprises at least one three-dimensional cylindrical surface defining a hollow body capable of fluid flow with a portion of the first flow joint surface being permeable (shaded) and a portion of the joint being impermeable (not shaded). At least one flow joint is a second (or secondary) flow joint 15. The second flow joint 15 comprises at least one three-dimensional cylindrical surface defining a hollow body capable of fluid flow with a portion of the surface being permeable (shaded) and a portion of the surface being impermeable (not shown). The length of the permeable and impermeable sections can be varied to obtain favorable fluid flow based on fluid flow dynamics and wellbore conditions. Preferably the length of the permeable and impermeable sections will be at least 7.5 centimeters (3 inches) long and more preferably at least 15 centimeters (6 inches) long.

At least one permeable section of the first flow joint 13 is connected to at least one permeable section of the second flow joint 15 thereby providing at least one fluid flow path between the first flow joint and the second flow joint. In the example of FIG. 2(*a*), the connection of the first 13 and second flow paths 15 is through the annulus 25 of the wellbore 10 which permits fluid flow through the permeable walls of the first flow joint 13 to the permeable walls of the second flow joints 15. The annulus 25 of the wellbore 10 can also be utilized as a third or tertiary flow joint. Other possible means for connecting a permeable section of the first flow path 13 to a permeable section of a second flow path 15 include, having the first 13 and second flow path 15 share the same permeable surface or having tubing connect the permeable sections. Persons skilled in the art, based on the disclosure herein, will recognize other means for connecting a permeable surface of the first flow joint 13 to a permeable section of the second flow joint 15. All such methods of connecting two permeable sections are included in this invention.

Arrow 19 indicates the direction of the hydrocarbon flow and arrows 17 illustrate possible flow paths through the primary 13 and secondary 15 flow joints. In this illustration the secondary flow joints 15 are connected to the primary flow joints 13 by mechanical connectors 21. Persons skilled in the art will recognize other methods to securely position the primary 13 and secondary joints 15 in the wellbore 10. As is illustrated by the fluid flow arrows 17, the arrangement of primary flow joints 13 and secondary flow joints 15 provides at least two flow paths with at least one connection capable of fluid flow between the two flow paths through the production apparatus. This embodiment permits adding additional flow joints as necessary through the use of an annulus 25, casing, well screen or other flow joint.

FIG. 2(*b*) is a cross-sectional view illustrating the fluid flow from primary flow joints 13 to secondary flow joints 15 to the annulus 25 wherein like elements from FIG. 2(*a*) are given the same reference numbers. The annulus 25 is the space between the primary 13 and secondary 15 flow joints and the casing (not shown) or formation sand 27 in an uncased well as in FIG. 2(*b*). In this example, the annulus 25 is utilized as a third (or tertiary) flow joint as well as a connection between the permeable walls of the first 13 and second flow joints 15. Furthermore, in this example, the production string 11 is a continuous tube inside the primary flow joint 13. However, the production string 11 can be a continuous tube in a flow joint such as, the primary flow joint 13 of FIG. 2(*a*) or it can be the inside of a flow joint and be continuous or discontinuous. As illustrated in FIG. 2(*a*) the primary flow joints 13 are connected with the production string 11 serving as a connector 29. The flow joints can be a discontinuous tube with connectors 29 as shown in FIG. 2(*a*) or it can be a continuous three-dimensional surface capable of fluid flow.

There are five possible example flow scenarios for the embodiment shown in FIGS. 2(*a*) and 2(*b*). The first flow scenario is normal fluid flow through the primary joints 13, secondary joints 15 and the annulus 25.

The second possible fluid flow scenario occurs when the primary joint 13 is plugged and fluid will flow through the secondary flow joint 15 and the annulus 25 but not through the primary flow joint 13. However, beyond the region where the primary flow joint 13 is plugged, the fluid flow would resume normal flow through the primary 13 and secondary flow joints 15 as well as the annulus 25. Likewise, this scenario can occur when the secondary flow joint 15 or annulus 25 is plugged. The flow is then diverted to the unplugged flow joints.

The third fluid flow scenario occurs when a primary flow joint 13 and the annulus 25 around the primary flow joint are plugged. The fluid at that point will flow through the secondary joints 15 past the plugged region and then back into the annulus 25 and primary fluid flow joint, resuming normal flow.

The fourth flow scenario is when the primary 13 and secondary flow joints 15 are plugged. In this scenario fluid would flow through the annulus 25 past the plugged region of the primary 13 and secondary flow joints 15 and resume a normal flow path through the primary 13, secondary flow joints 15 as well as through the well annulus 25.

The fifth scenario occurs when the secondary joint 15 and the annulus 25 are plugged. In this scenario the fluid flows through the primary flow joint 13 past the plugged region of the secondary flow joint 15 and the annulus 25 and then resumes normal flow through the primary flow joint 13, secondary flow joint 15 and the annulus 25.

The specific combination of compartment baffles encompassing the Mazeflo completion system is determined based on the desired reliability, productivity, production profile, accessibility, and other functional requirements for the well. The design of the compartments and baffles is dependent on factors such as manufacturing, materials, locale of installation (for example, factory or via well workover), and other desired functional requirements for the well. These other functional requirements may include, but are not limited to: exclusion of produced solids (sand control), improved mechanical strength or flexibility, exclusion or inclusion of specific fluids (downhole diversion and fluid conformance), delivery of treatment chemicals (for example, scale inhibitors, corrosion inhibitors, etc.), isolation of specific formation types, control of production rate and/or pressures, and measurement of fluid properties. Persons skilled in the art, with the benefit of the disclosures herein, can design the flow paths including the compartments and baffles for favorable fluid flow based on the functional requirements discussed above. The Mazeflo completion system may be used in cased-hole and open-hole wellbores, either for producers or injectors.

FIG. 3(*a*) illustrates one embodiment wherein the flow joints are created by installing permeable or partially permeable surfaces 31 in the wellbore 10. A portion of the surface 31 in the wellbore 10 is permeable and a portion is impermeable. The permeable surfaces allow commingling of the fluid flow from the different compartments as shown by fluid flow arrows 33. The portions of the walls that are impermeable or partially permeable are equivalent to previously defined flow joints and allow fluid flow past the point where the other compartments are plugged.

FIG. 3(*d*) is a side view illustration of FIG. 3(*a*) to illustrate the walls inside the wellbore. The walls 31 in FIGS. 3(*a*) and 3(*d*) may be permeable, impermeable or contain some sections that are permeable and some sections that are impermeable.

An alternate embodiment is shown in FIG. 3(*b*) where a first circular compartment 39 is inside a wellbore 10 and the space between the inner circular compartment 39 and the outer circular compartment (not shown) or wellbore 10 may be further compartmentalized by placing additional surfaces 31 between the inner circular compartment 39 and the wellbore 10. In this embodiment the larger area outside circular compartment 39 would be designated the first flow joint 34. Other outer circular compartments and the smaller inner compartment would be designated as second 36, third 38, and fourth 40 flow joints as shown in FIG. 3(*b*). Additional compartments (not shown) may be created and labeled fifth, sixth, and higher flow joints.

FIG. 3(*c*) illustrates a different configuration embodiment wherein the two circular compartments 35 are inserted into a wellbore 10 and the wellbore 10 is further compartmentalized by the addition of a wall 31. As discussed above, the walls would preferably have regions that are permeable and impermeable to provide commingling flow in some areas and separate distinct flows in other areas, allowing fluid flows to bypass regions where flow joints are plugged. The embodiment shown in FIG. 3(*c*) would have five flow joints and the flow joints are labeled first 34, second 36, third 38, fourth 40, and fifth 44 as shown in FIG. 3(*c*).

FIG. 4(*a*) illustrates an additional embodiment of the Mazeflo completion system involving concentrically and longitudinally stacked multiple flow joints. As shown in FIG. 4(*a*), each joint is bounded by either permeable (dashed line) 55 or impermeable (solid line) 57 media.

In this example, each stack of longitudinal compartments can be treated as a flow joint. Two examples of compartments are labeled 51 and 53 in FIG. 4(*a*). In this example, the primary compartment or first flow joint 54 is the largest concentric compartment in the middle of the wellbore. The outermost compartment 51 and the compartment 53 between the outermost compartment and the innermost compartment are identified as the second and third flow joints or secondary, or tertiary flow joints respectively. If the outermost flow joint fails and particulates plug the flow joint, the outer wall of compartment 53 would prevent sand infiltration but allow fluid to pass through. Continuous sand invasion increases the sand concentration in the first flow joint 51 and subsequently increases the frictional pressure loss, resulting in gradually diminished fluid/sand flow into the first flow joint 51. Fluid production is then diverted to other flow joints without permeable media failure.

FIGS. 4(*b*), 4(*c*), and 4(*d*) are cross-sectional views of FIG. 4(*a*) at designated location of FIG. 4(*a*) wherein like elements from FIG. 4(*a*) are given the same reference numbers. These figures illustrate the changes from permeable walls (dashed lines) to impermeable walls (solid lines) based on the location in the wellbore.

The permeable media 55 in FIG. 4(*a*) could be a wire-wrapped screen wherein the gap between two wires is sufficient to retain most formation sand produced into wellbore. In one embodiment, the impermeable section 57 adjacent to the permeable media 55 could be formed by a blank pipe, impermeable material wrapped on the outside of a permeable media, or a wire-wrapped screen without a gap between adjacent wires. Manufacturing of a wire-wrapped screen is well known in the art and involves wrapping the wire at a present pitch level to achieve a certain gap between two adjacent wires. One embodiment of a Mazeflo screen could be manufactured by varying the pitch used to manufacture conventional wire-wrapped screens. For example, one portion of a single joint of wire-wrapped screen could be wrapped at a desired pitch that would retain most formation sand, as illustrated by 55 in FIG. 4(*a*). The next portion of the screen could be wrapped at near zero or zero pitch (no gap) to be created an essentially impermeable media section as illustrated by 57 in FIG. 4(*a*). Other portions of the screen joint could be wrapped at varying pitches to create varying levels of permeable sections or impermeable sections.

Additional compartments 50 inside the flow joint can be created by adding more walls 59. The compartments 50 created by the additional walls 59 can be used as separate flow joints increasing the number of flow joints, thus increasing the number of redundancies. The wall 59 may be made of permeable material, impermeable material or with some sections of permeable material and some sections of impermeable materials. FIGS. 4(*b*), 4(*c*), and 4(*d*) illustrate flow joints 51, 53, 50 created by both permeable 55 and impermeable 57 concentric walls and further compartmentalization of the flow joints by adding more walls 59.

The number of compartments along the circumference depends on borehole size and the type of permeable media. Fewer compartments would enable larger compartment size and result in fewer redundant flow paths if sand infiltrates the first or outermost compartment 51. The outermost compartment may be partially or entirely defined by a sand screen. An excessive number of compartments would decrease the compartment size, increase frictional pressure losses, and reduce well productivity. Depending on media type, the second flow joint 53 may be designed to be smaller or larger than compartment 51. The impermeable walls (solid boundaries along compartments 51 and 53) could reduce erosion impact from fluid and sands to the permeable media between the outer 51 and inner 53 flow joints, respectively. The multiple compartments in FIG. 4(*a*) could also be unevenly divided or assembled eccentrically in the wellbore.

As shown in FIG. 4(*a*), preferably at least one impermeable and permeable section of the flow joints are adjacent. More preferably, at any cross-section location of the Mazeflo at least one wall of the flow joint should be impermeable. Therefore, there is in this preferred embodiment, at least one flow joint that is impermeable is adjacent to at least one flow joint that is permeable at any cross-section location of the Mazeflo apparatus. This preferred embodiment is illustrated in FIGS. 4(*b*), 4(*c*) and 4(*d*) whereby there are at any given cross-section location, at least one wall that is impermeable and at least one wall that is permeable.

Additional flow joints may be added as necessary for possible use in gravel packing operations. FIG. 5(*a*) is an example of the Mazeflo completion System and FIGS. 5(*b*), 5(*c*), and 5(*d*) are cross-sectional views of FIG. 5(*a*) at the designated location of FIG. 5(*a*) wherein like elements are assigned the same reference numbers as in FIGS. 4(*a*), 4(*b*), 4(*c*), and 4(*d*). These figures illustrate an additional flow joint utilizing shunt tubes and nozzle ports. Shunt tubes 61 could be placed longitudinally along selected compartments to enhance gravel packing (as disclosed in U.S. Pat. Nos. 4,945,991, 5,082,052, and 5,113,935). Shunt tubes 61 are extended beyond compartment boundary 51 into the wellbore annulus 68. Selected shunt tubes 61 could utilize rupture disks (not shown) and nozzle ports 63 to allow gravel slurry diversion into the annulus 68. The Mazeflo completion system is suitable for use in both conventional and alternate path gravel packing operations.

EXAMPLE

Figure 6B:
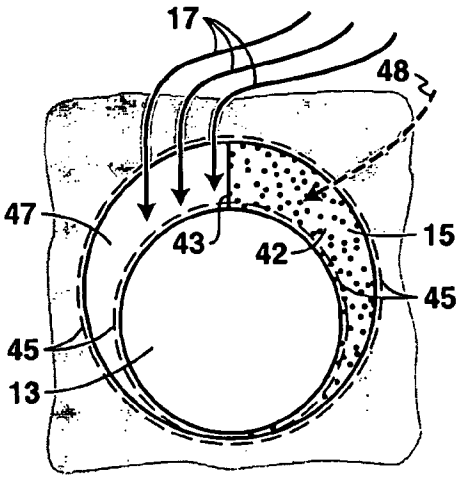
FIG. 6(*a*) is a side view of a wellbore using an embodiment of the Mazeflo completion system illustrating a possible fluid flowpath during sand infiltration into a wellbore.
Figure 6A:
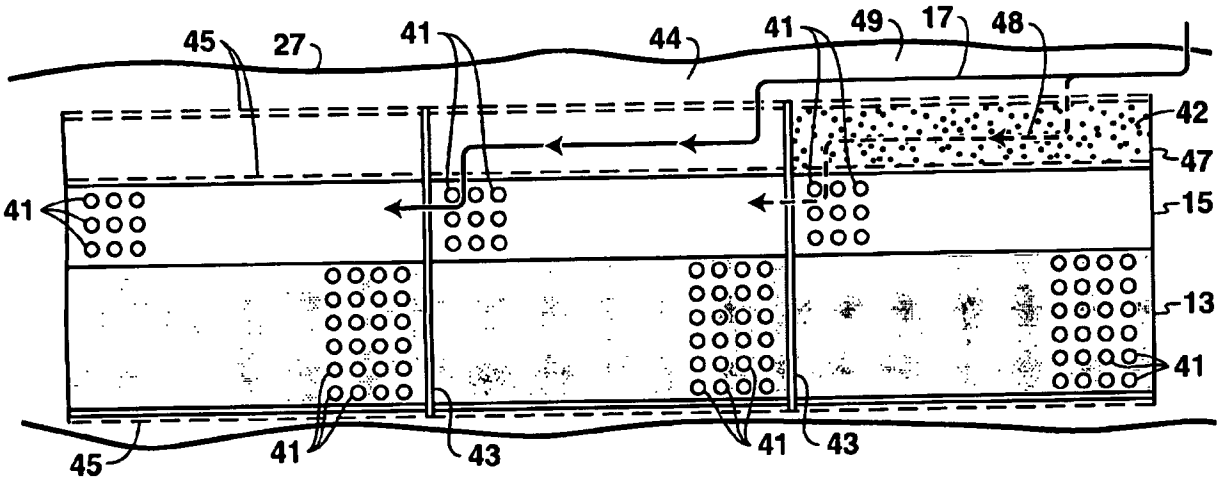

FIG. 6(*a*) illustrates a side view of the Mazeflo completion system concept of fluid flow redirection during a sand screen failure. The large basepipe is identified as the first or primary joint 13 and the smaller adjacent basepipe is identified as the second or secondary flow joint 15. In FIG. 6(*a*) there are two sand screens 45 with the sand screens represented in the illustration as dotted lines. The sand screens separate the primary 13 and secondary flow joints 15 from the annulus and also separates the annulus into two annuli. One annulus is between the secondary flow joint 15 and the outer well screen 45, while the other annulus is between the outer well screen 45 and the formation sand 27. In this example, the two annuli would be utilized as the third 47 and fourth 49 flow joints.

The embodiment illustrated in FIG. 6(*a*) employs two selectively perforated, adjacent basepipes. The basepipes are impermeable with selected perforation 41 to create regions of permeable surfaces. Each basepipe may be fitted with some type of commercially available sand screen. An additional wall (may or may not be permeable) or baffle 43 may be placed within the larger pipe to redirect flow into distinct flow regions, as shown in FIG. 6(*a*). The spacing of the perforations 41 in each basepipe will determine the relative amounts of fluids that will flow into and between the three compartments. Additional baffles may be placed at various axial locations to redirect flow into different compartments.

For a single joint of pipe (for example, 9 to 12 meters (30 or 40 feet) in length) defining a first flow joint with both permeable and impermeable media, an outer sand screen defining a second flow joint, and a wellbore annulus utilized as a third flow joint, the completion maze will consist of five distinct flow scenarios as discussed above. Persons skilled in the art can configure the pipes wherein conventional tubular connections can be used to join consecutive joints of pipe.

FIG. 6(*b*) is an end view of an eccentric Mazeflo completion system with flow joints created by the sand screens 45 and the wall 43. The flow joints defined by the sand screens 45 and wall 43 are designated first flow joint 13, second flow joint 15, and third flow joint 47 as shown in FIG. 6(*b*).

The areas of impermeable compartments allow fluid flow to bypass areas that are plugged into non-plugged compartments. This commingling permits flow out of a compartment that is plugged into a compartment that is non-plugged. Persons skilled in the art based on the disclosure herein can arrange the compartments to provide adequate commingling to permit efficient flow around any compartments that may be plugged.

FIG. 6(*b*) further illustrates sand screen failure. The solid arrow 17 indicates possible flowpaths and the dotted arrows 48 indicate blocked flowpaths. When the sand screen fails allowing infiltration of sand 42, one or more compartments could be plugged. However, fluid would continue to flow into the other compartments 47 that are not plugged, and that are protected from the sand infiltration by the additional wall 43. Therefore, fluid production would continue despite the failure of the sand screen.

The concept of Mazeflo completion was demonstrated in a laboratory wellbore flow model. The flow model had a 25 centimeter (10-inch) OD, 7.6 meter (25-foot) Lucite pipe to simulate an open hole or casing. The demonstrative apparatus, was positioned inside the Lucite pipe and includes a series of three screen sections. The three screen sections consisted of an eroded Mazeflo screen, an intact Mazeflo screen section, and an eroded conventional screen. Each screen was 15 centimeters (6 inches) in diameter and 1.8 meters (6-feet) long. The Mazeflo apparatus included a 91 centimeter (3-foot) long slotted liner and a 91 centimeter (3-foot) long blankpipe as the primary (outer) flow joint. The 7.5 centimeter (3-inch) OD, secondary (inner) Mazeflo joint contained a 1.2 meter (4-foot) long blankpipe and a 61 centimeter (2-foot) long wire-wrapped screen. The primary and secondary flow joints in the tested Mazeflo apparatus were concentric. During the test, water containing gravel sand was pumped into the annulus between the screen assembly (completion system) and the Lucite pipe (open hole or casing).

The slurry (water and sand) first flowed through the annulus and into the eroded Mazeflo screen. The sand entering the eroded Mazeflo screen was retained and packed on the inner (secondary) flow joint. The growing sand pack between the primary (outer) and secondary (inner) flow joints increased the flow resistance and slowed down the sand entering the eroded Mazeflo screen. As the sand entering the eroded Mazeflo screen was diminishing, the slurry (water and sand) was diverted further downstream to the adjacent intact Mazeflo screen. The gravel sand was packed in the annulus between the intact Mazeflo screen and the Lucite pipe. Since this Mazeflo screen was intact, the sand was retained by the primary (outer) flow joint. As the intact Mazeflo screen section was externally packed, the slurry was diverted to the next eroded conventional screen. The sand flowed around and into the eroded conventional screen. Since the conventional screen was not equipped with any secondary or redundant flow joints, the sand continuously entered the eroded screen and could not be controlled.

The experiment illustrated the Mazeflo concept during the gravel packing portion of well completion operations. If part of the sand screen media is damaged during screen installation or eroded during gravel packing operations, a Mazeflo screen is able to retain gravel by a secondary (redundant) flow joint and enable continuation of normal gravel packing operations. However, a conventional screen could not control gravel loss and potentially cause an incomplete gravel pack. The incomplete gravel pack with a conventional screen later causes formation sand production during well production. Excessive sand production reduces well productivity, damages downhole equipment, and creates a safety hazard on the surface.

This experiment also illustrated the Mazeflo concept during well production in gravel packed completion or standalone completion. If part of the screen media is damaged or eroded during well production, a Mazeflo screen can retain gravel or natural sand pack (formation sand) in a secondary (redundant) flow joint, maintain the annular gravel pack or natural sand pack integrity, divert flow to other intact screens, and continue sand-free production. In contrast, a damaged conventional screen will cause a continuous loss of gravel pack sand or natural sand pack followed by continuous formation sand production.

What is claimed is:

1. A wellbore apparatus comprising:

a) a first conduit in a wellbore, the first conduit comprising at least one three-dimensional surface defining a first fluid flow path through the wellbore within the first conduit, wherein at least one section of the first conduit surface being permeable and at least one section of the first conduit surface being impermeable, wherein the permeable section is adapted to retain particles larger than a predetermined size while allowing fluids to pass through the permeable surface;

b) a second conduit in the wellbore, the second conduit comprising at least one three-dimensional surface defining a second fluid flow path through the wellbore within the second conduit, wherein at least one section of the second conduit surface is permeable and at least one section of the second conduit surface being impermeable; wherein the permeable section is adapted to retain particles larger than a predetermined size while allowing fluids to pass through the permeable surface; wherein at least one permeable section of the first conduit surface is in fluid communication with at least one permeable section of the second conduit surface providing fluid communication between the first flow path and the second flow path; and c) at least one wall inside the first flow path or the second flow path to form at least one compartment in the first flow path or the second flow path; wherein the compartment has at least one inlet and at least one outlet; and wherein the at least one compartment is adapted to accumulate particles in the compartment to progressively increase resistance to fluid flow through the compartment in the event the at least one inlet is impaired and allows particles larger than a predetermined size to pass into the compartment.

2. The apparatus of claim 1 wherein the first and second conduits are selectively perforated basepipes.

3. The apparatus of claim 1 wherein the first conduit is adjacent to the second conduit in the wellbore.

4. The apparatus of claim 1 wherein the first conduit is concentric to the second conduit in the wellbore.

5. The apparatus of claim 1 wherein at least one conduit comprises joints of pipe.

6. The apparatus of claim 1 wherein the first conduit is eccentric to the second conduit in the wellbore.

7. The apparatus of claim 5 wherein the joints of pipe are connected using flexible joints.

8. The apparatus of claim 1 wherein the three-dimensional surface of the first and second conduits are cylindrical.

9. The apparatus of claim 1 wherein at least one wellbore wall is utilized as a conduit.

10. The apparatus of claim 1 wherein at least one conduit is a sand screen.

11. The apparatus of claim 10 wherein the sand screen is a wire-wrapped screen and the wires of the wire-wrapped screen are wrapped at varying pitches thereby creating varying levels of permeable sections and impermeable sections.

12. The apparatus of claim 1 further comprising at least one shunt tube in at least one conduit.

13. The apparatus of claim 1 wherein the apparatus is used for producing hydrocarbons.

14. The apparatus of claim 1 wherein the apparatus is used for gravel packing a well.

15. The apparatus of claim 1 wherein at least one impermeable section of the first conduit or the second conduit and at least one permeable section of the first conduit or the second conduit are each at least 7.5 centimeters long.

16. The apparatus of claim 1 wherein at least one impermeable section of the first conduit or the second conduit and at least one permeable section of the first conduit or the second conduit are each at least 15 centimeters long.

17. The apparatus of claim 1 wherein at least one impermeable section of the first conduit is adjacent to at least one permeable section of a third conduit.

18. The apparatus of claim 1 wherein at any cross-section location of the apparatus, at least one surface of at least one conduit is impermeable.

19. The apparatus of claim 1 wherein at any cross-section location at least one surface of at least one conduit is impermeable and at least one surface of at least one conduit is permeable.

20. The apparatus of claim 1 wherein the at least one wall forms a predefined shape and comprises at least one of a permeable portion, an impermeable portion, and combination thereof.

21. The apparatus of claim 1 wherein the first conduit and the second conduit are different lengths within the wellbore.

22. The apparatus of claim 1 wherein the first conduit or second conduit comprises a plurality of sections having a central opening through each of the plurality of sections.

23. The apparatus of claim 1 wherein the first conduit or second conduit is impermeable on at least one end of the first conduit or second conduit.

24. The apparatus of claim 1 wherein the at least one permeable section of the first conduit surface and the at least one permeable section of the second conduit surface are offset providing at least one flow direction change for fluids passing from the first flow path to the second flow path.

25. The apparatus of claim 1 wherein the at least one inlet to the compartment is provided by the at least one permeable section of the first conduit surface or the at least one permeable section of the second conduit surface, and wherein the at least one outlet is provided by the at least one permeable section of the second conduit surface or the at least one permeable section of the first conduit surface.

26. The apparatus of claim 1 wherein the at least one compartment includes at least one permeable section of the first conduit, at least one impermeable section of the first conduit, at least one permeable section of the second conduit, and at least one impermeable section of the second conduit.

27. A wellbore apparatus comprising;

a) a first selectively perforated basepipe inside a wellbore defining a first fluid flow path through the wellbore within the first basepipe, with at least one section of the first selectively perforated basepipe being impermeable and at least one section of the first perforated basepipe being permeable, wherein the permeable section is adapted to retain particles larger than a predetermined size while allowing fluids to pass through the permeable surface;

b) a second selectively perforated basepipe inside the wellbore defining a second fluid flow path through the wellbore within the second basepipe, with at least one section of the second selectively perforated basepipe being impermeable and at least one section of the second perforated basepipe being permeable; wherein the permeable section is adapted to retain particles larger than a predetermined size while allowing fluids to pass through the permeable surface; wherein at least one permeable section of the first basepipe is in fluid communication with at least one permeable section of the second basepipe providing fluid communication between the first flow path and the second flow path; and c) at least one wall disposed inside the first flow path or the second flow path to form at least one compartment in the first flow path or the second flow path; wherein the compartment has at least one inlet and at least one outlet; and wherein the at least one compartment is adapted to accumulate particles in the compartment to progressively increase resistance to fluid flow through the compartment in the event the at least one inlet is impaired and allows particles larger then a predetermined size to pass into the compartment.

28. The apparatus of claim 27 wherein the basepipes are concentric.

29. The apparatus of claim 27 wherein the basepipes are eccentric.

30. The apparatus of claim 27 wherein the basepipes are adjacent.

31. The apparatus of claim 28 wherein the first selectively perforated basepipe is larger than the second selectively perforated basepipe and the at least one wall is coupled between the first selectively perforated basepipe and the second selectively perforated basepipe to provide at least one additional flow path inside the first selectively perforated basepipe.

32. The apparatus of claim 29 wherein the first selectively perforated basepipe is larger than the second selectively perforated basepipe and the at least one wall is coupled between the first selectively perforated basepipe and the second selectively perforated basepipe to provide at least one additional flow path inside the first selectively perforated basepipe.

33. The apparatus of claim 27 wherein the perforations of the first selectively perforated basepipe are chosen based on the relative amount of fluids that will flow through the at least one permeable section.

34. The apparatus of claim 27 further comprising at least one shunt tube in the first selectively perforated basepipe or the second selectively perforated basepipe.

35. The apparatus of claim 27 wherein at least three flow paths are available through the wellbore.

36. The apparatus of claim 30 wherein the first selectively perforated basepipe and the second selectively perforated basepipe are connected with flexible tubes.

37. The apparatus of claim 27 wherein at least one impermeable section of the first selectively perforated basepipe or the second selectively perforated basepipe and at least one permeable section of the first selectively perforated basepipe or the second selectively perforated basepipe are each at least 7.5 centimeters long.

38. The apparatus of claim 27 wherein at least one impermeable section of the first selectively perforated basepipe or the second selectively perforated basepipe and at least one permeable section of the first selectively perforated basepipe or the second selectively perforated basepipe are each at least 15 centimeters long.

39. The apparatus of claim 27 wherein at least one impermeable section of the first selectively perforated basepipe or the second selectively perforated basepipe is adjacent to at least one permeable section of a third selectively perforated basepipe.

40. The apparatus of claim 20 wherein at any cross-section location of the apparatus, at least one wall of the first selectively perforated basepipe or the second selectively perforated basepipe is impermeable.

41. The apparatus of claim 27 wherein at any cross-section location at least one wall of the first selectively perforated basepipe or the second selectively perforated basepipe is impermeable and at least one wall of the other one of the first selectively perforated basepipe and the second selectively perforated basepipe is permeable.

42. The apparatus of claim 27 wherein the at least one of first selectively perforated basepipe, the second selectively perforated basepipe, and combination is a sand screen.

43. The apparatus of claim 27 wherein the at least one wall forms a specific shape in the first selectively perforated basepipe and comprises at least one of a permeable material, an impermeable material, and combination thereof.

44. The apparatus of claim 27 wherein the first selectively perforated basepipe and the second selectively perforated basepipe are different lengths within the wellbore.

45. The apparatus of claim 27 wherein the at least one permeable section of the first basepipe and the at least one permeable section of the second basepipe are offset providing at least one flow direction change for fluids passing from the first flow path to the second flow path.

46. The apparatus of claim 27 wherein the at least one inlet to the compartment is provided by the at least one permeable section of the first basepipe or the at least one permeable section of the second basepipe, and wherein the at least one outlet is provided by the at least one permeable section of the second basepipe or the at least one permeable section of the first basepipe.

47. The apparatus of claim 27 wherein the at least one compartment includes at least one permeable section of the first basepipe, at least one impermeable section of the first basepipe, at least one permeable section of the second basepipe, and at least one impermeable section of the second basepipe.

48. The apparatus of claim 30 wherein the first selectively perforated basepipe and the second selectively perforated basepipe are connected with flexible tubes.

49. A method for completing a wellbore comprising:

a) providing a wellbore apparatus for producing hydrocarbons comprising a first conduit in a wellbore, the first conduit comprising at least one three-dimensional surface defining a first flow path through the wellbore within the first conduit, wherein at least one section of the first conduit surface is permeable and at least one section of the first conduit surface is impermeable, a second conduit in a wellbore, the second conduit comprising at least one three-dimensional surface defining a second fluid flow path through the wellbore with at least one section of the second conduit surface being permeable and at least one section of the second conduit surface being impermeable; wherein at least one permeable section of the first conduit surface is in fluid communication with at least one permeable section of the second conduit surface providing fluid communication between the first flow path and the second flow path; and at least one wall inside the first flow path or the second flow path to form at least one compartment in the first flow path or the second flow path; wherein at least one compartment is adapted to accumulate particles in the compartment to progressively increase resistance to fluid flow through the compartment in the event the at least one inlet is impaired and allows particles larger than a predetermined size to pass into the compartment; and b) installing the wellbore apparatus in the wellbore.

50. The method of claim 49 wherein installing the wellbore apparatus provides at least two separate flow paths in the wellbore with at least one connection permitting fluid flow between the first flow path and the second flow path.

51. The method of claim 49 wherein the apparatus is used for producing hydrocarbons.

52. The method of claim 49 wherein the apparatus is used for gravel packing a well.

53. The method of claim 49 further comprising producing hydrocarbons from the wellbore.

54. The method of claim 53 further comprising producing hydrocarbons from the wellbore apparatus after the first conduit or second conduit has been mechanically damaged.

55. The method of claim 49 further comprising disposing at least one shunt tube in at least one of the first conduit and the second conduit, and gravel packing the wellbore using the shunt tube in the first conduit or the second conduit.

56. The method of claim 49 wherein the first conduit or the second conduit comprises a sand screen; and further comprising installing a complete gravel pack during gravel packing operations after the sand screen has been mechanically damaged.

57. The method of claim 49 wherein the at least one wall forms a predefined shape in the first conduit or second conduit and comprises at least one of a permeable section, an impermeable section, and combination thereof.

58. The method of claim 49 wherein the first conduit or second conduit comprises a plurality of sections having a central opening through each of the plurality of sections.

59. The method of claim 49 wherein the first conduit or second conduit is impermeable on at least one end of the first conduit or second conduit.

60. A method of flowing fluids in a wellbore comprising;

a) providing a wellbore with an apparatus comprising a first conduit in a wellbore, the first conduit comprising at least one three-dimensional surface defining a first flow path through the wellbore within the first conduit, wherein at least one section of the first surface is permeable and at least one section of the first conduit surface is impermeable; a second conduit in the wellbore, the second conduit comprising at least one three-dimensional surface defining a second flow path through the wellbore, wherein at least one section of the second conduit surface is permeable and at least one section of the second conduit surface is impermeable; wherein at least one permeable section of the first conduit is in fluid communication with at least one permeable section of the second conduit surface providing fluid communication between the first flow path and the second flow path; and at least one wall inside the first flow path or the second flow path to form at least one compartment in the first flow path or the second flow path; wherein the compartment has at least one inlet and at least one outlet; and wherein the at least one compartment is adapted to accumulate particles in the compartment to progressively increase resistance to fluid flow through the compartment in the event the at least one inlet is impaired and allows particles larger than a predetermined size to pass into the compartment.

61. The method of claim 60 further comprising producing hydrocarbons through the first conduit or the second conduit.

62. The method of claim 60 further comprising injecting fluids into the well through the first conduit and the second conduit.

63. The method of claim 60 wherein the at least one wall forms a shape within the first conduit or second conduit and comprises at least one of a permeable material, an impermeable material, and combination thereof.

64. A wellbore apparatus comprising;

a first perforated basepipe configured to provide a first fluid flow path through a wellbore, wherein the first perforated basepipe has at least a first impermeable section and at least a first permeable section;

a second perforated basepipe configured to provide a second fluid flow path through the wellbore, wherein the second perforated basepipe has at least a second impermeable section and at least a second permeable section and the first permeable section and the second permeable section are connected to provide a flow path between the first perforated basepipe and the second perforated basepipe; and wherein the basepipes are eccentric; and at least one baffle disposed inside the first perforated basepipe or the second perforated basepipe to provide at least one additional fluid flow path.

65. A wellbore apparatus comprising:

a first perforated basepipe configured to provide a first fluid flow path through a wellbore, wherein the first perforated basepipe has at least a first impermeable section and at least a first permeable section;

a second perforated basepipe configured to provide a second fluid flow path through the wellbore, wherein the second perforated basepipe has at least a second impermeable section and at least a second permeable section and the first permeable section and the second permeable section are connected to provide a flow path between the first perforated basepipe and the second perforated basepipe; and wherein the basepipes are adjacent; and at least one baffle disposed inside the first perforated basepipe or the second perforated basepipe to provide at least one additional fluid flow path.

66. A wellbore apparatus comprising:

a perforated basepipe configured to provide a first fluid flow path through a wellbore, wherein the perforated basepipe has at least an impermeable section and at a permeable section;

a plurality of walls inside the perforated basepipe to provide a plurality of compartments in the first fluid flow path; and a redundant perforated basepipe configured to provide a third fluid flow path through the wellbore, the redundant perforated basepipe comprising at least a redundant impermeable section and at least a redundant permeable section, wherein the permeable section and the redundant permeable section are in fluid communication through the compartment between the perforated basepipe and the redundant perforated basepipe; wherein the compartment is adapted accumulate particles to progressively increase resistance to fluid flow through the compartment in the event the at least one permeable section of the perforated basepipe or the redundant perforated basepipe is impaired and allows particles larger than a predetermined size to pass into the compartment.

67. The apparatus of claim 66 wherein the perforated basepipe comprises a sand screen.

68. The apparatus of claim 66 wherein the plurality of walls comprises a first wall, a second wall and a third wall, wherein each of the walls are coupled between the perforated basepipe and the first wall, second wall, third wall, or combination thereof.

69. The apparatus of claim 66 wherein the basepipes are concentric.

70. The apparatus of claim 66 wherein the basepipes are eccentric.

71. The apparatus of claim 66 wherein the basepipes are adjacent.

72. The apparatus of claim 66 wherein at least one wall of the plurality of walls redirects the fluid into the plurality of compartments.

73. The apparatus of claim 66 wherein the at least one wall forms a predefined shape in the perforated basepipe and comprises at least one of a permeable material, an impermeable material, and combination thereof.

74. A wellbore apparatus comprising:

a) a first flow joint in a wellbore, the first flow joint comprising at least one three-dimensional surface defining a first fluid flow path through the wellbore, at least one section of the first flow joint surface being permeable and at least one section of the first flow joint surface being impermeable;

b) a second flow joint in the wellbore, the second flow joint comprising at least one three-dimensional surface defining a second fluid flow path through the wellbore, at least one section of the second flow joint surface being permeable and at least one section of the second flow joint surface being impermeable;

c) at least one wall inside the first flow joint or the second flow joint to form at least a third fluid flow path; and d) wherein at least one permeable section of the first flow joint is connected to at least one permeable section of the second flow joint thereby providing at least one fluid flow path between the first flow joint and the second flow joint; and wherein at least one flow joint comprises a sand screen including a wire-wrapped screen wherein the wires of the wire-wrapped screen are wrapped at varying pitches thereby creating varying levels of permeable sections and impermeable sections.

75. A wellbore apparatus comprising:

a) a first flow joint in a wellbore, the first flow joint comprising at least one three-dimensional surface defining a first fluid flow path through the wellbore, at least one section of the first flow joint surface being permeable and at least one section of the first flow joint surface being impermeable;

b) a second flow joint in the wellbore, the second flow joint comprising at least one three-dimensional surface defining a second fluid flow path through the wellbore, at least one section of the second flow joint surface being permeable and at least one section of the second flow joint surface being impermeable;

c) at least one shunt tube in at least one flow joint;

d) at least one wall inside the first flow joint or the second flow joint to form at least a third fluid flow path; and e) wherein at least one permeable section of the first flow joint is connected to at least one permeable section of the second flow joint thereby providing at least one fluid flow path between the first flow joint and the second flow joint.

76. A wellbore apparatus comprising;

a) a first selectively perforated basepipe inside a wellbore defining a first fluid flow path through the wellbore, with at least one section of the first selectively perforated basepipe being impermeable and at least one section of the first perforated basepipe being permeable;

b) a second selectively perforated basepipe inside the wellbore defining a second fluid flow path through the wellbore, with at least one section of the second selectively perforated basepipe being impermeable and at least one section of the second perforated basepipe being permeable, wherein the first and second basepipes are eccentric;

c) at least one wall disposed inside and coupled to the first selectively perforated basepipe or the second selectively perforated basepipe to provide at least one additional fluid flow path; and d) wherein at least one permeable section of the first selectively perforated basepipe and at least one permeable section of the second selectively perforated basepipe are connected to provide at least one flow path between the first selectively perforated basepipe and the second selectively perforated basepipe.

77. A wellbore apparatus comprising;

a) a first selectively perforated basepipe inside a wellbore defining a first fluid flow path through the wellbore, with at least one section of the first selectively perforated basepipe being impermeable and at least one section of the first perforated basepipe being permeable;

b) a second selectively perforated basepipe inside the wellbore defining a second fluid flow path through the wellbore, with at least one section of the second selectively perforated basepipe being impermeable and at least one section of the second perforated basepipe being permeable, wherein the first and second basepipes are adjacent;

c) at least one wall disposed inside and coupled to the first selectively perforated basepipe or the second selectively perforated basepipe to provide at least one additional fluid flow path; and d) wherein at least one permeable section of the first selectively perforated basepipe and at least one permeable section of the second selectively perforated basepipe are connected to provide at least one flow path between the first selectively perforated basepipe and the second selectively perforated basepipe.

78. A wellbore apparatus comprising;

a) a first selectively perforated basepipe inside a wellbore defining a first fluid flow path through the wellbore, with at least one section of the first selectively perforated basepipe being impermeable and at least one section of the first perforated basepipe being permeable;

b) a second selectively perforated basepipe inside the wellbore defining a second fluid flow path through the wellbore, with at least one section of the second selectively perforated basepipe being impermeable and at least one section of the second perforated basepipe being permeable, wherein the first and second basepipes are eccentric;

c) at least one shunt tube in the first selectively perforated basepipe or the second selectively perforated basepipe;

d) at least one wall disposed inside and coupled to the first selectively perforated basepipe or the second selectively perforated basepipe to provide at least one additional fluid flow path; and e) wherein at least one permeable section of the first selectively perforated basepipe and at least one permeable section of the second selectively perforated basepipe are connected to provide at least one flow path between the first selectively perforated basepipe and the second selectively perforated basepipe.

79. A method for completing a wellbore comprising:

a) providing a wellbore apparatus for producing hydrocarbons comprising a first flow joint in a wellbore, the first flow joint comprising at least one three-dimensional surface defining a first fluid flow path through the wellbore with at least one section of the first flow joint surface being permeable and at least one section of the first flow joint surface being impermeable, a second flow joint in a wellbore, the second flow joint comprising at least one three-dimensional surface defining a second fluid flow path through the wellbore with at least one section of the first second flow joint surface being permeable and at least one section of the first second flow joint surface being impermeable, at least one wall disposed in the first flow joint or the second flow joint to form at least a third fluid flow path, wherein at least one permeable section of the first flow joint is connected to at least one permeable section of the second flow joint thereby providing at least one fluid flow path between the first flow joint and the second flow joint;

b) disposing at least one shunt tube in at least one of the first conduit and the second conduit;

c) installing the wellbore apparatus in the wellbore; and d) gravel packing the wellbore using the shunt tube in the first conduit or the second conduit.

* * * * *